US006618956B1

(12) United States Patent
Schilp et al.

(10) Patent No.: US 6,618,956 B1
(45) Date of Patent: Sep. 16, 2003

(54) DEVICE FOR DEWATERING AND DRYING SUSPENSIONS

(75) Inventors: Lucia Baumann Schilp, Mainstrasse 8, D-82237 Woerthsee (DE); Uwe Zacher, Kolbermoor (DE)

(73) Assignee: Lucia Baumann Schilp (DE)

( * ) Notice: Subject to any disclaimer, the term of this patent is extended or adjusted under 35 U.S.C. 154(b) by 0 days.

(21) Appl. No.: 09/242,038

(22) PCT Filed: Mar. 27, 1997

(86) PCT No.: PCT/EP97/01570

§ 371 (c)(1),
(2), (4) Date: Jan. 23, 2002

(87) PCT Pub. No.: WO98/05912

PCT Pub. Date: Feb. 12, 1998

(30) Foreign Application Priority Data

Aug. 5, 1996 (DE) ..... 196 31 605

(51) Int. Cl.[7] ..... F26B 17/30

(52) U.S. Cl. ..... 34/58; 34/68; 34/139; 34/586; 34/593

(58) Field of Search ..... 34/586, 593, 58, 34/68, 69, 131, 134, 595, 139

(56) References Cited

U.S. PATENT DOCUMENTS

| | | | | |
|---|---|---|---|---|
| 3,194,492 A | | 7/1965 | Koffinke et al. | |
| 3,724,091 A | * | 4/1973 | Rousselet | 34/58 |
| 4,581,009 A | * | 4/1986 | Kramer | 494/37 |
| 4,692,248 A | * | 9/1987 | Stannard et al. | 210/403 |
| 5,085,443 A | | 2/1992 | Richards | |
| 5,426,866 A | * | 6/1995 | Rumocki | 34/321 |
| 6,193,643 B1 | * | 2/2001 | Larsson | 494/26 |

FOREIGN PATENT DOCUMENTS

| | | |
|---|---|---|
| DE | 948 497 C | 8/1956 |
| DE | 43 32 799 A | 3/1995 |
| EP | 0 591 299 A | 4/1994 |

* cited by examiner

*Primary Examiner*—Ira S. Lazarus
*Assistant Examiner*—Kathryn S. OMalley
(74) *Attorney, Agent, or Firm*—Venable LLP; Robert Kinberg

(57) ABSTRACT

The operation of dewatering and drying devices which consist of a dewatering centrifuge and a concentrically arranged spray drier may be disturbed by leaks between the drier housing and the centrifuge or by deposits and encrustation of solid particles inside the drier. In order to avoid these disturbances, the rotating outer surface of the centrifuge (1) is sealed with respect to the fixed front walls (13, 14) of the drier housing (11) by a sealing system in two or more stages which consists of rotary seals (160) and elastic or sliding sealing elements (180, 260, 300, 340). The rotating outer surface of the centrifuge (1) is provided, with turbulence-generating means (32, 33, 40, 42, 46), preferably torus-shaped turbulence-generating rollers, arranged inside the drier housing (11).

55 Claims, 11 Drawing Sheets

DEVICE FOR DEWATERING AND DRYING SUSPENSIONS

BACKGROUND OF THE INVENTION

The invention relates to a device for dewatering and drying suspensions. A dewatering and drying device of this type is known from EP 0591299.

In the known dewatering and drying device, the 0.3–3-mm moist solid particles sprayed radially at high speed at the discharge of the centrifuge, preferably a full-jacketed helical-conveyor centrifuge, are diverted by suitable means, for example, diverting surfaces or a suitable gas flow, in the axial direction of the centrifuge and guided by the gas flow on a helical flight path in the drying chamber. Here the sprayed solid particles are flowed around at a high relative speed by the drying gas and dried. The drying chamber is a concentric annular chamber. It is embodied by the outer drier housing, the inside, rotating drum jacket of the centrifuge, or an inside housing surrounding the drum and the two housing end walls. The outside walls of the concentric drying chamber are stationary, and must be sealed, at least at one location, against the rotating parts of the centrifuge inside.

The rotary seal between the centrifuge rotor and the surrounding drier housing must overcome and tolerate a high relative speed, a gas-difference pressure between the inside and outside, and displacement movements due to thermal expansions and vibrations. The seal is intended to prevent or minimize the escape of gases from the drier interior to the outside, or the entrance of secondary air from the outside to the inside.

It has been seen that the seal gap between stationary housing parts and rotating centrifuge parts changes in an unacceptable manner particularly because of thermal expansion during heating processes in the startup phase, or with the occurrence of vibrations or changes in the temperature of the drier housing. This can lead to contact between the seal surfaces from time to time, and damage to or destruction of the seal.

To avoid this, the gap width must be selected to be large enough that thermal expansions and displacements of the drier housing do not lead to touching of the contactless seals.

A further disadvantage is that the gap also changes due to vibrations of the dewatering centrifuge inside the drier, because the rotating and non-rotating parts of the seal are respectively secured to different seal carriers.

An excessively-large seal gap is particularly disadvantageous in the operation of the centrifuge drier with an inert-gas atmosphere, because the entrance of the secondary air noticeably increases the oxygen content of the inert drying gas.

A further disadvantage of the dewatering and drying device known from EP 0 591 299 relates to the diverting surfaces for the solid particles that are spun out of the rotating centrifuge. Despite the use of wall scrapers that are secured to the rotating centrifuge drum, deposits and encrustations can occur on the diverting surfaces, as well as in the drier housing or the downstream devices (washer, cyclone) if the centrifuge effects poor mechanical pre-dewatering of the suspension, or if the solid particles are very sticky and moist. In continuous drying operation, this causes disturbances and breakdowns, which is economically disadvantageous. Up to now, attempts have been made to effect positive changes in the moisture behavior and stickiness of difficult-to-dewater suspensions by mixing them with additives prior to centrifuging. This measure is, however, quite expensive.

SUMMARY OF THE INVENTION

It is the object of the invention to implement constructive measures to avoid disturbances in operation, as caused by either seal leakages between the drier housing and the centrifuge or deposits and encrustations of solid particles, in a dewatering and drying device of the type mentioned at the outset.

The invention provides the generation of a free dispersion of the pre-dewatered solids through mechanically-induced rolling turbulences of the drying gas; good distribution of the dispersed solid particles in the drying gas; the most uniform possible distribution of the particle concentration in the drying gas; and the blowing away of encrustation layers that may build up. The concentration of the small, dispersed, moist particles in the drier chamber should be uniform and low, and the relative speed of the hot gas in relation to the particles should be as high as possible to assure rapid drying of the moist solid particles in flight. For example, elements that induce the gas flow and assure a powerful turbulence in the vicinity of the surfaces in the drier chamber, which are at risk for encrustation, or at the diverting surfaces, are secured to the outside of the rotating centrifuge drum so as to project into the drier chamber. The surfaces of the work chamber walls in the drier can be polished or coated with an anti-adhesive to promote the prevention of encrustation. The directing and guiding sheets built into the drier chamber purposefully influence the flow of the hot gas to effect a uniform gas distribution, avoid dead spaces and assure an intensive contact of the hot gas with the moist solid particles. Perforated walls through which gas flows are also suitable for preventing encrustations due to moist, sticky solid particles if the hot gas flowing in keeps the sticky particles away from the walls until the particle surfaces have dried sufficiently and, having a lower moisture content, lose their tendency to stick. Particularly in organic clarification sludges having a pronounced adhesive phase, the tendency to stick is especially strong in certain moisture ranges and must be overcome in fractions of seconds in flight.

The invention further provides a sealing of the radial end walls of the drier housing against the rotating jacket surface of the centrifuge with a rotary seal, which can keep the seal gap very narrow without the risk of mechanical contact between the rotating and non-rotating work surfaces of the rotary seal, and thus damage to or destruction of these surfaces. A further advantage of the rotary seal is that even uncontrollable, large displacement and expansion movements of the drier housing during the heating or cooling phase of the centrifuge drier, or stronger vibrations during the operation, do not affect the sealing function, despite the narrow gap of the rotary seal. The escape of inside gases or solids or the entrance of secondary air into the inert drying gas is virtually entirely prevented by the narrow seal gap.

A further advantage of the invention is the avoidance of encrustations and baked-on buildup, even in difficult-to-dewater sludges. This expands the use and application range of the device of the invention to products which, after the mechanical dewatering, yield a solid that is extremely sticky or possesses a very high moisture content. Breakdowns caused by baked-on buildup as a result of excessively-moist mechanical pre-dewatering in the centrifuge, and the associated costs, are also avoided.

BRIEF DESCRIPTION OF THE DRAWINGS

Further details, advantages and features of the invention are explained in detail by way of embodiments illustrated in the drawings.

Shown are in.

DETAILED DESCRIPTION OF THE INVENTION

Figure 1:
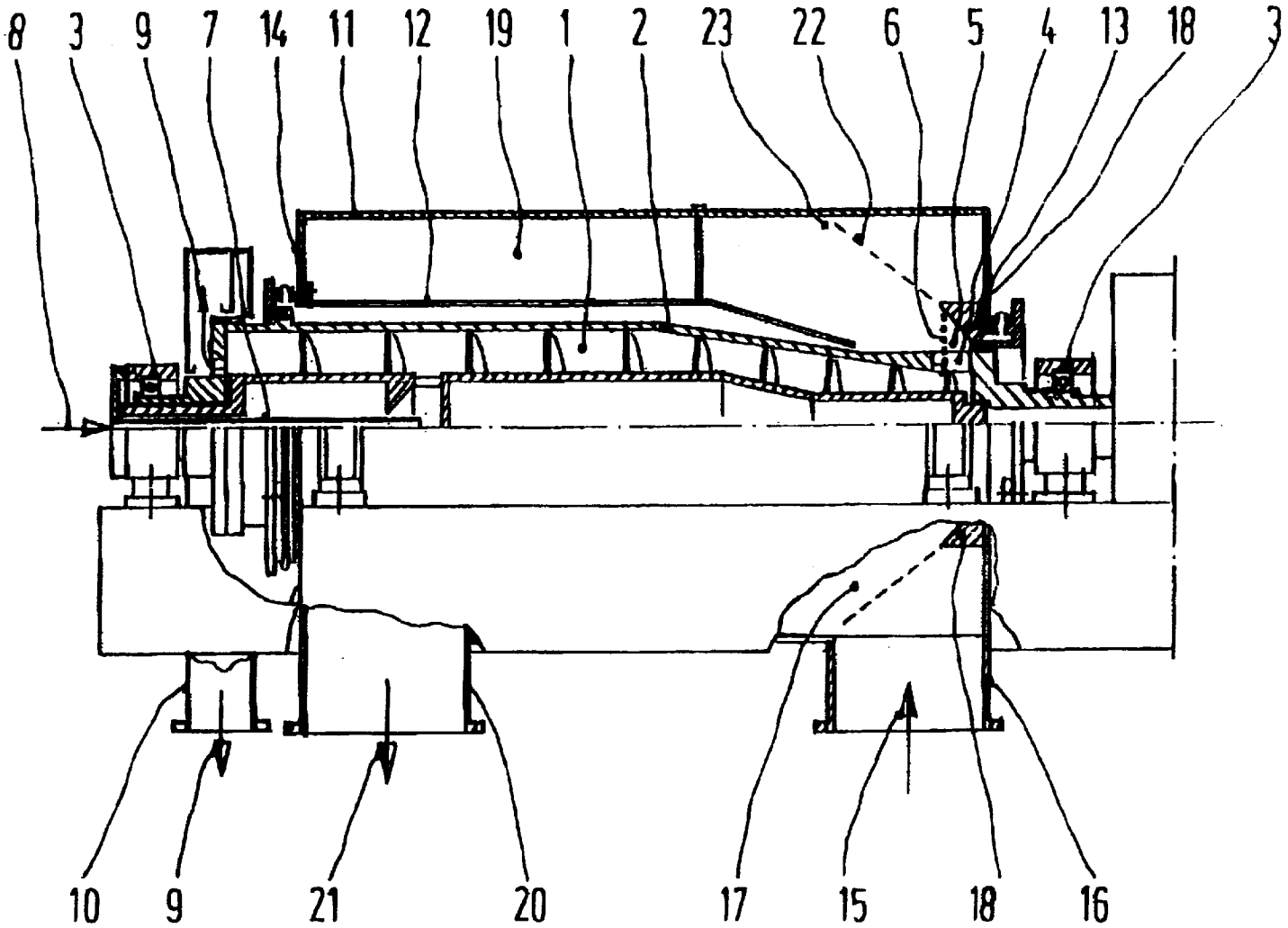
FIG. 1 a longitudinal section of a dewatering and drying device (referred to hereinafter as "centrifuge drier") having perforated gas-guiding sheets.

In the illustrated example, the dewatering and drying device ("centrifuge drier") shown in FIG. 1 has a full-jacketed helical-conveyor centrifuge 1 of a design known per se. Instead of the illustrated full-jacketed helical-conveyor centrifuge, it is possible to use other centrifuges that are suitable for dewatering suspensions such as sludges, for example basket helical-conveyor centrifuges or three-phase separators, in which one phase is to be dried.

The full-jacketed helical-conveyor centrifuge 1, referred to hereinafter as "dewatering centrifuge" or "centrifuge" for short, has a rotating drum 2, which is rotatably seated at its axial ends on roller bearings 3. The drum 2 tapers conically at one or both ends, and is provided at its tapered end with discharge openings 4, which form the discharge zone 5 for the pre-dewatered solid 6. The suspension, for example liquid sludge 8, supplied through a pipe 7 into the interior of the centrifuge 1 is separated in the centrifuge 1 into a solid 6 and a clarified liquid 9 due to centrifugal forces, the liquid being sprayed out of the centrifuge 1 into a separate housing 10, the central chute, at the other end of the drum jacket 2.

The drier directly surrounding the centrifuge 1 is formed by an outside drier housing 11 and an inside housing 12 that surrounds the rotating drum 2, or by the drum 2 itself and the two end walls 13 and 14. The drying gas 15 is introduced, for example tangentially, into the drier chamber 17 through a hot-gas shaft 16, then flows around the dispersed solid 6, present in particle form, which is then diverted in the axial direction by the baffle cone 18; the gas then transports the dried solid particles in helical paths through the concentric annular chamber 19 to the discharge channel 20 of the drier housing 11. From here, the drying gas 21 carrying the dried solid particles flows out through a pneumatic conveyor line, not shown, to a solids separator, and is separated again there into gas and a solids bed.

For uniformly distributing the hot drying gas 15 entering the concentric annular chamber 19, and mixing it thoroughly with the solid particles diverted and slowed by the baffle cone 18, a perforated sheet 22, for example having a conical shape, is provided, through which the hot gas 15 flows. The perforated sheet 22 can comprise a conical surface or a series of sections having different conical angles, hole shapes, slots, free opening cross sections or partial solid-sheet sections for attaining the aforementioned effects. Full or partial annular gaps 23 can also be embodied between the perforated sheet 22, the baffle cone 18 and/or the drier housing 11 for preventing an undesired accumulation of solids. The distributor sheet 22, which can be flowed through, can also deviate from the cone shape and have a bowl shape, a cylindrical shape or a planar shape, or it can be a combination of different shapes.

Figure 2:
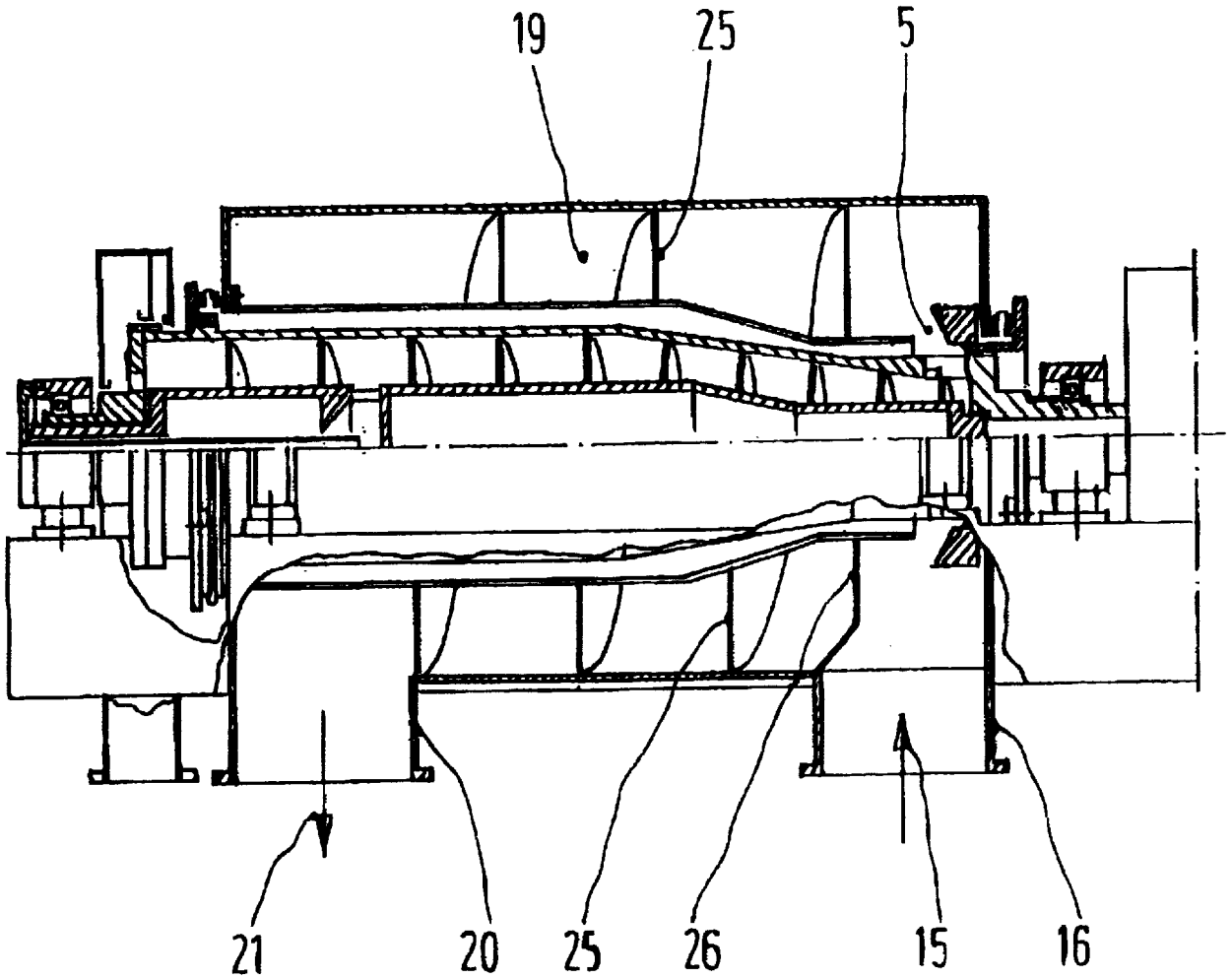
FIG. 2 a longitudinal section of a centrifuge drier with directing sheets in the drier chamber.

FIG. 2 shows a combination centrifuge drier equipped with directing elements 25, 26 in the concentric annular drier chamber. The centrifuge drier is constructed from components similar to those in FIG. 1, and functions similarly to the drier of FIG. 1. Instead of the perforated sheet 22, however, helical directing sheets 25, 26 are built into the drier chamber 19; these sheets effect a restricted guidance of the flow of gas in the concentric drier chamber 19, and prevent bypasses between the hot-gas entrance 16 and the gas exit 20. The helical shape of the directing sheet 26 can preferably have a less-steep pitch than the directing sheets 25 disposed behind the directing sheet 26 in the axial direction. With a suitable embodiment of the directing sheet 26 (which is disposed in the entrance region of the hot gas 15), it is possible to reduce the number of directing sheets 25 extending over nearly the entire length of the drier housing 11 or on the directing,sheets 25, or omit the sheets 25 altogether. The hot gas 15 (also called "drying gas") entering, for example, tangentially is guided around nearly the entire circumference in the region of the discharge zone of the dispersed, moist solid 6 by a directing sheet 26, and is penetrated there by solid particles. The solids-laden drying gas 15 is guided to the drier exit 20 through the helical directing sheets 25 in helical paths. The directing sheets 25 and 26 avoid dead zones, i.e., areas that are not flowed through, in the drier chamber 19, and, overall, forcibly effect a predetermined minimum transport speed of the drying gas 15 and a uniform residence time of the dispersed solid particles.

Figure 3:
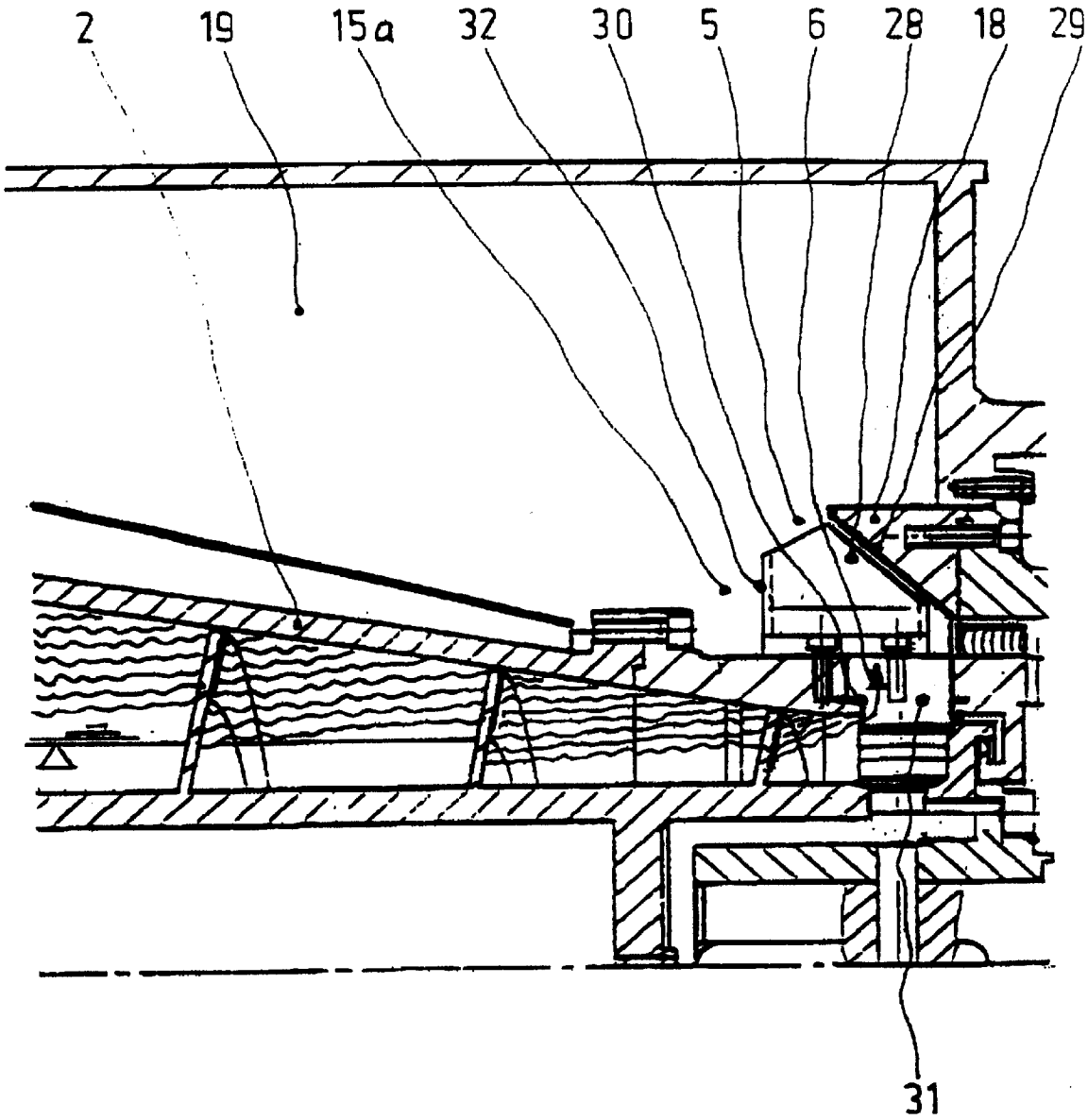
FIG. 3 the dispersion zone of a centrifuge drier having rotating cleaning blades for the diverting surfaces of the dispersed particles.

FIG. 3 shows an enlargement of the discharge zone 5 of a combination centrifuge drier having two or more rotating cleaning blades 28, which clean the diverting surface 29 of the baffle cone 18 with each rotor rotation. The pre-dewatered solid 6 is transported by the helical conveyor of the centrifuge 1 to the spraying edge 30, and is ejected at high speed from the rotor 2. The solid particles impact the surface 29 of the baffle cone 18, and are broken into smaller particles and slowed there. The slowed particles fly at a greatly-reduced speed, and are diverted in the axial direction as a conical solid-spray mist into the drier chamber 19, where they are flowed around intensively by hot gas and dried. The cleaning blades 28 are secured to the rotor behind the solids exit openings 31, when seen in the direction of rotation, and are not showered by the exiting solid 6. If, when very moist or sticky solid particles 6 impact the diverting surface 29, a few particles are not reflected, and remain stuck on the diverting surface 29, they are torn loose by the subsequent rotating cleaning blades 28 and spun into the drier chamber 19. The blades 28, which rotate at a high circumferential speed of about 60 m/s, also exert an aspirating and conveying effect on the surrounding hot gas 15*a*;

consequently, the surrounding hot gas 15*a* partially conveys the solids dust located in the drier chamber 19 into the discharge zone 5. The cleaning blades eject the dust-laden hot gas 15*a* aspirated by the blades 28 and the scraped solid particles into the drier chamber 19, either radially or conically, depending on the shape of the guide surfaces. To intensify the gas conveyance, aspirating and directing sheets 32 can be mounted to the blades.

Figure 4:
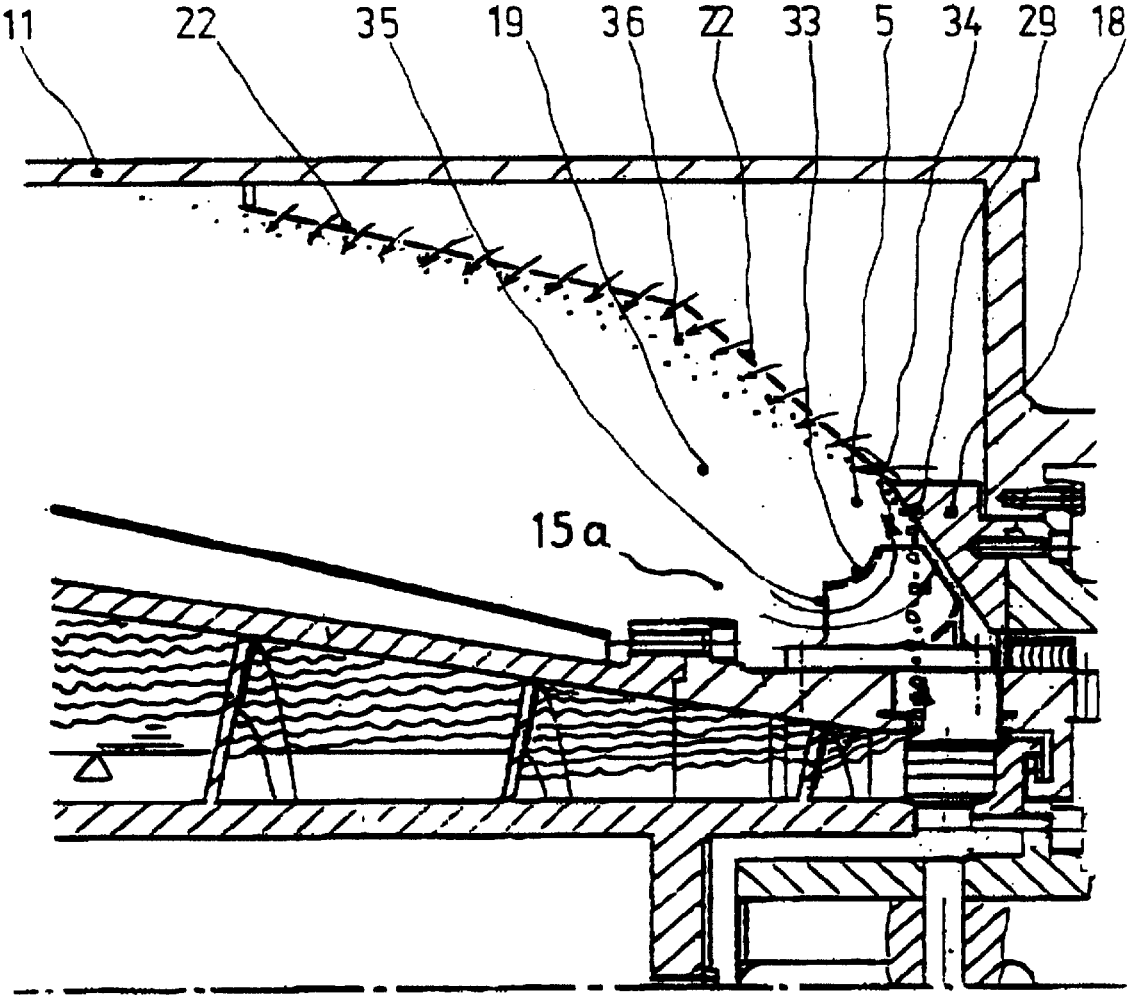
FIG. 4 the dispersion zone of a centrifuge drier having rotating turbulence blades for keeping the drier walls clean.

FIG. 4 shows the discharge zone 5 of a centrifuge drier, with a steeper angle of the baffle cone 18, perforated gas-guiding sheets 22 and rotating blower blades. In contrast to the cleaning blades 28 in FIG. 3, the cleaning effect of the blower blades 33 is not based on a scraping effect, but on the blowing effect of the intensive gas flow 34 flowing out of the rotating nozzle 33 at a flat angle and onto the surface 29 of the baffle cone 18 to be cleaned. The gas conveyance through the blower blades 33 is particularly intensified by appropriate measures, such as large aspiration cross sections at the blade entrance 35, directing elements in the blade and directed blowing at the blade exit. The aspirating effect of the dust-laden hot gas 15*a* at the blade entrance side 35, and the hot gas 36 exiting the perforated gas-guiding surfaces 22, keep the gas flow in the drier chamber 19, with the dispersed solid particles 6, away from the walls of the drier housing 11 and more toward the inside. Prior to impacting the surface 29 of the baffle cone 18, the solid 6 flying from the spraying edge 30 of the centrifuge drum 2 enters the inflow region of the hot gas 15*a*, which contains dust, and is conveyed by the blower blade 33. The surfaces of the solid particles are thereby dried and coated with dry solids dust, so they lose their tendency to stick before contacting the surface 29. To further reduce the sticking tendency, the diverting surface can also be coated with a suitable material, such as PTFE, enamel, ceramic or other anti-adhesive materials. The surface 29 can also comprise a perforated surface and be ventilated from the back.

Figure 5:
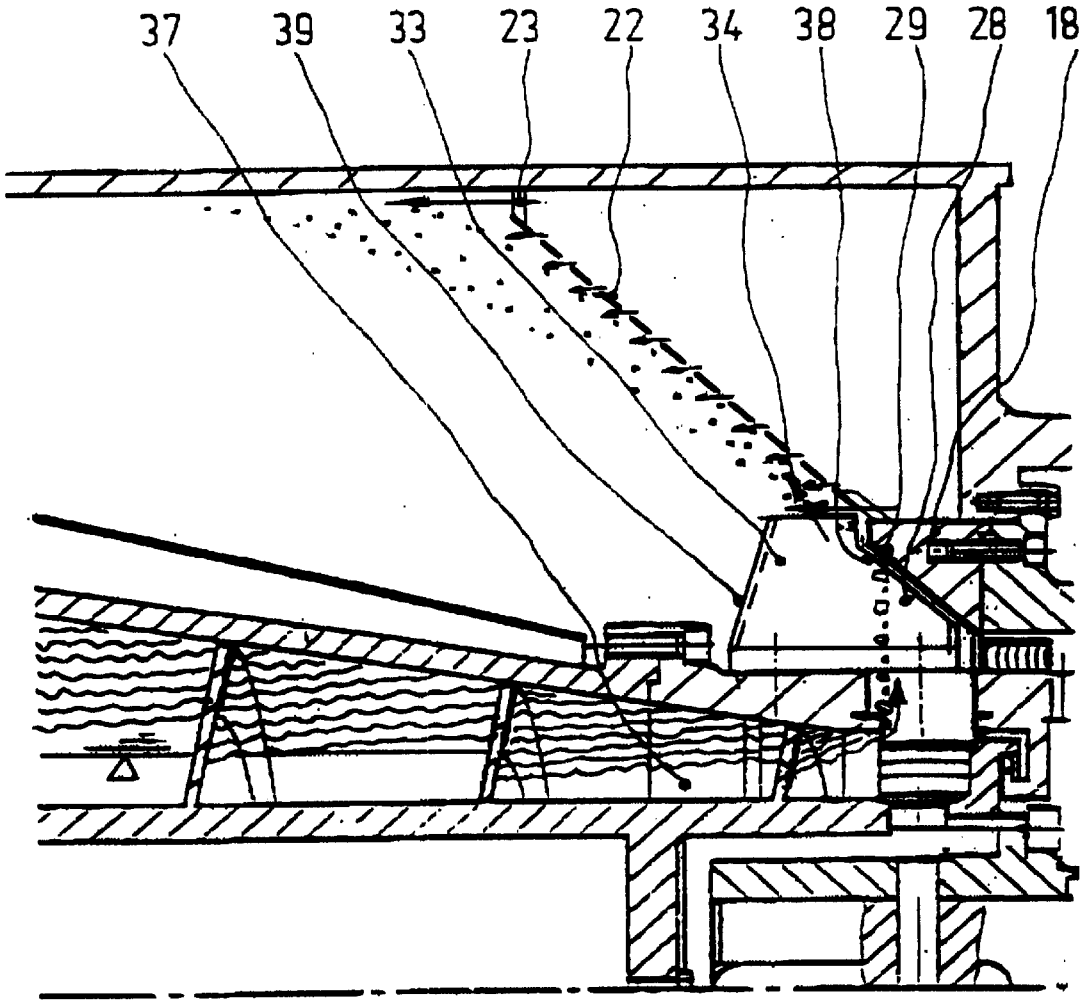
FIG. 5 a combination of cleaning and turbulence blades for preventing encrustations in the interior of the drier and lines.

FIG. 5 shows a combination of a rotating cleaning blade 28 and a blower blade 33, which cooperates with a perforated gas-guiding sheet 22. The surface 29 of the baffle cone 18 is cleaned by a rotating scraper 38 in connection with the blowing effect of the aspirated hot gas. The exiting jet 34 is not only directed at the surface of the baffle cone, but also blows tangentially onto the perforated gas-guiding sheet 22. The side wall 39 that aspirates the hot gas can be slightly sloped with respect to the circumferential direction, or provided with openings to be able to aspirate more gas. The edges of the discharge openings 4 of the centrifuge 1 exert a conveying effect on the gas within the interior 37 of the centrifuge 1. This conveying effect causes the moist-gas to be aspirated from the interior 37 of the centrifuge 1, and hot, dry gas to be drawn in, so the moist solid 6 is already pre-dried in the helical pitch of the centrifuge 1, with a long residence time, before being discharged.

Figure 6:
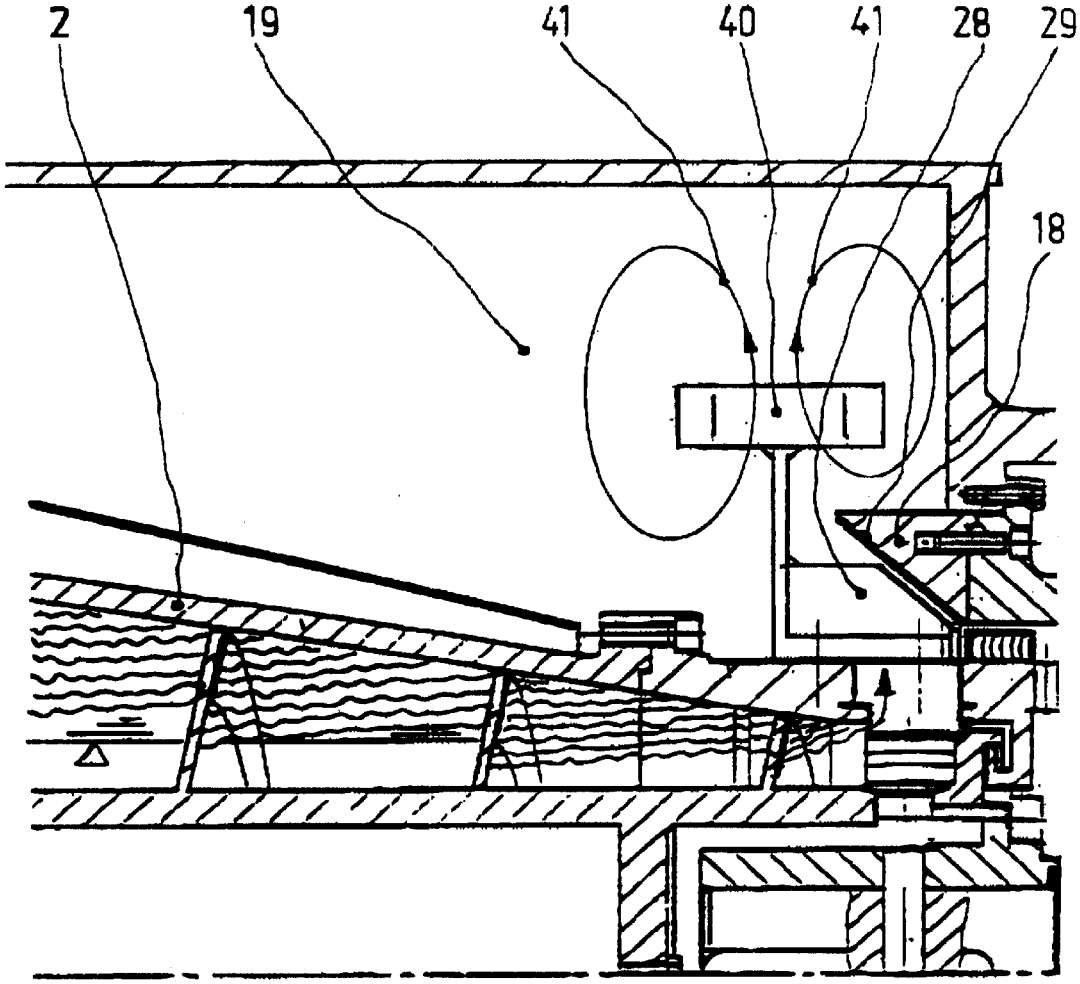
FIG. 6 a combination of turbulence and transport blades for keeping the interior of the drier clean.

FIG. 6 shows a combination of a turbulence blade 40 for keeping the drier chamber 19 clean, and a cleaning blade 28 for cleaning the surface 29 of the baffle cone 18. The turbulence blade 40 possesses a high circumferential speed, and generates a strong vortex 41 of the drying gas in the drier chamber 19. This avoids non-flowed-through dead zones, and the entering drying gas 15 is intensively mixed with the dispersed particles. As shown, the cleaning blade 28 can scrape or blow on a part of the surface 29 of the baffle cone, or the entire surface. The blades 28 and/or 40 can be rigidly secured to the rotor 2, or secured thereto so as to oscillate.

Figure 7:
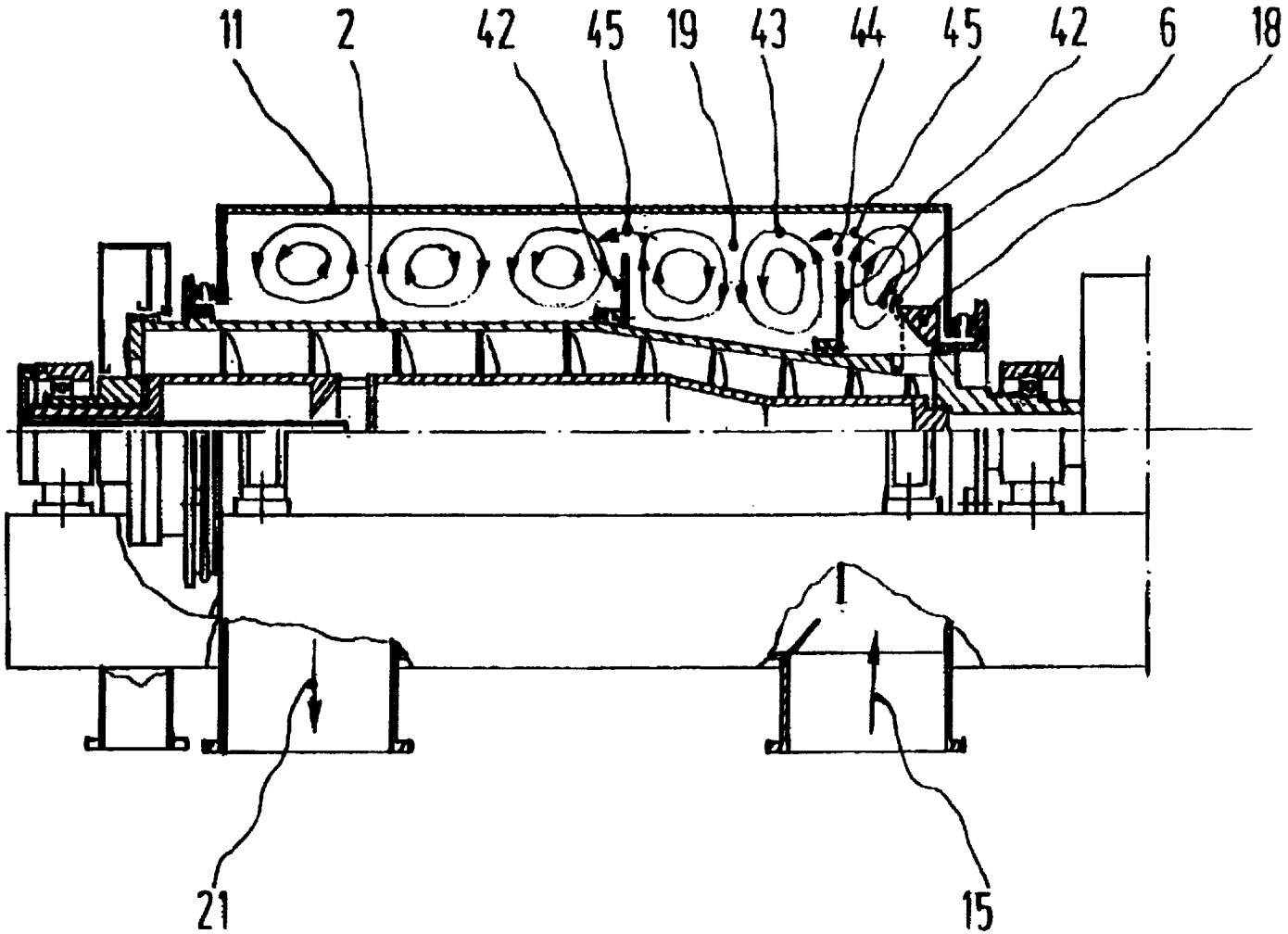
FIG. 7 rotating turbulence disks in the drier chamber for generating rolling turbulences for re-dispersion.

In FIG. 7, rotating turbulence disks are built into the drier chamber 19 for generating rolling turbulences 43. The drier housing 11 is embodied without a stationary inside housing 12, which, in some embodiments of the centrifuge drier, surrounds the drum 2. The concentric drier chamber 19 is therefore limited on the outside by a non-rotating cylinder wall, and on the inside by the rapidly-rotating centrifuge drum 2. The rotating surface of the drum 2, in connection with the rapidly-rotating disks 42, induces a series of circulating, rolling turbulences 43 in the drier chamber 19. These rolling turbulences 43 are driven by the rotating surfaces of the drum 2 and the disks 42, create a high turbulence degree over the entire cross section, and even out the flow-through of the drier chamber 19 in the circumferential direction. The high turbulence degree of the rolling turbulences prevents deposits on the limiting walls of the drier housing 11, compels a thorough mixing of drying gas and the dispersed solid particles, and generates a high drying speed for the moist solid particles in connection with an extremely-high water-evaporation rate with respect to the a drier volume. The axial movement of the entering hot gas 15 is evened out over the entire circumference by the passage gap 44 outside of the rotating disks 42, and by the torus-shaped, rolling turbulences. Instead of the rotating disks 42, other elements can also be used at the centrifuge drum 2 to generate rolling turbulences in the drier, such as a radial blade ring, axial or radial conveying wheels, beater arms or other known, suitable mounted parts.

Figure 8:
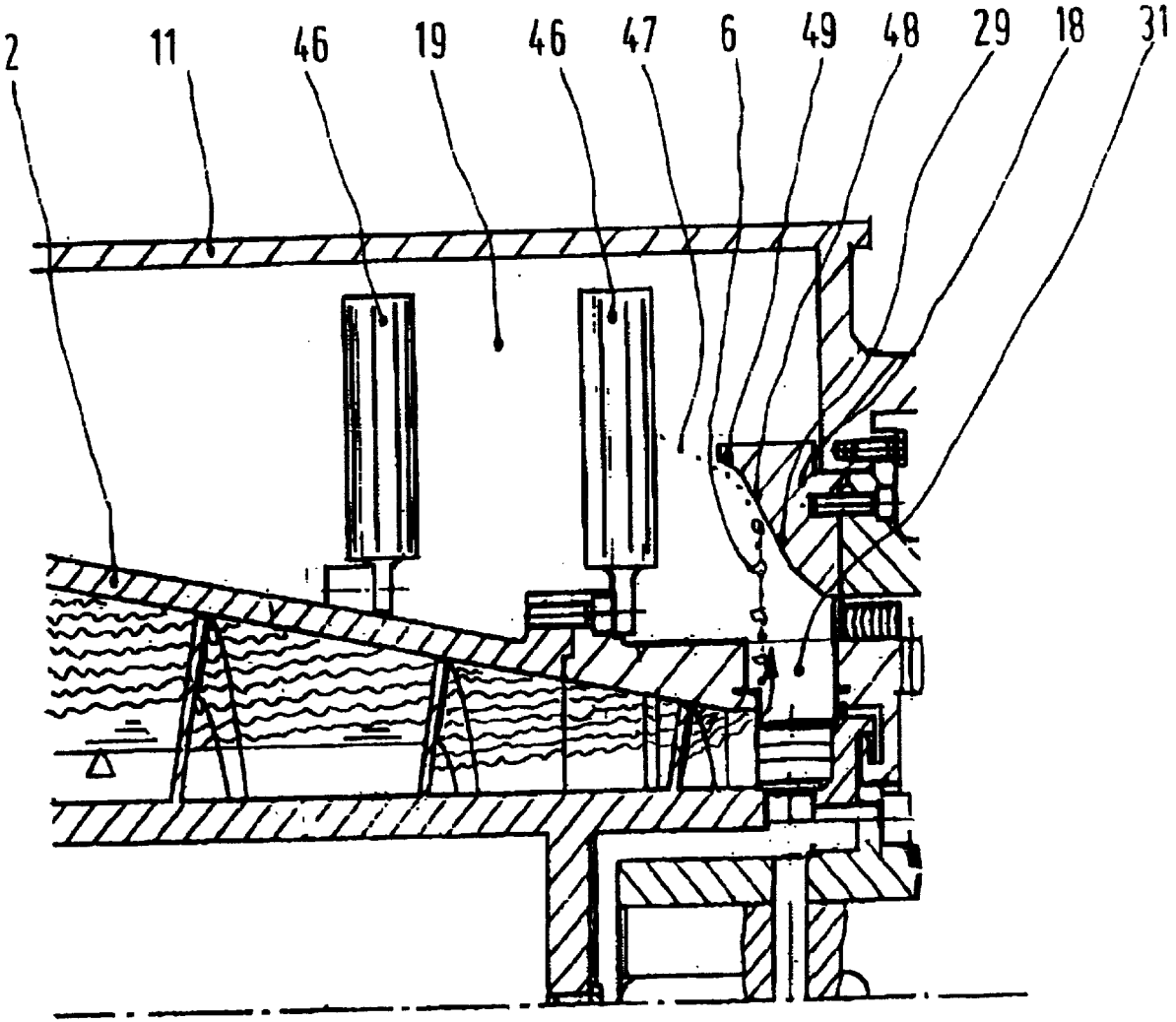
FIG. 8 diverting surfaces for better dispersion and wider distribution of the pre-dewatered, moist solid particles.

In FIG. 8, one or a plurality of blade rings 46 is mounted to the outside of the rotating centrifuge drum 2 for creating a high turbulence degree in the drier chamber 19, and for uniform axial conveyance and control of the residence time of the solids-laden drying gas. In addition to these functions, the blade rings 46 also effect a comminution of agglomerates in the drier chamber 19. The surface 29 of the baffle cone 18 comprises a plurality of geometrically-assembled, smooth surfaces. At the impact zone 48 of the pre-dewatered, dispersed solid 6, the surface comprises a flat cone adjoined further outward by a rounded surface contour 49. The flat angle of impact of the dispersed, moist solid particles 6 against the smooth baffle cone 18 has a favorable effect on their reflection and further transport, despite the fact that they are broken into smaller particles 47. The generally-desired, more severe diversion in the axial flight direction is effected further outward by the sliding of the particles on the rounded surface contour 49 of the baffle cone 18. The additional sliding of the broken-down particles further reduces their entry speed into the drier chamber 19, thus reducing the risk of baked-on buildup on the walls of the drier housing 11.

Figure 9:
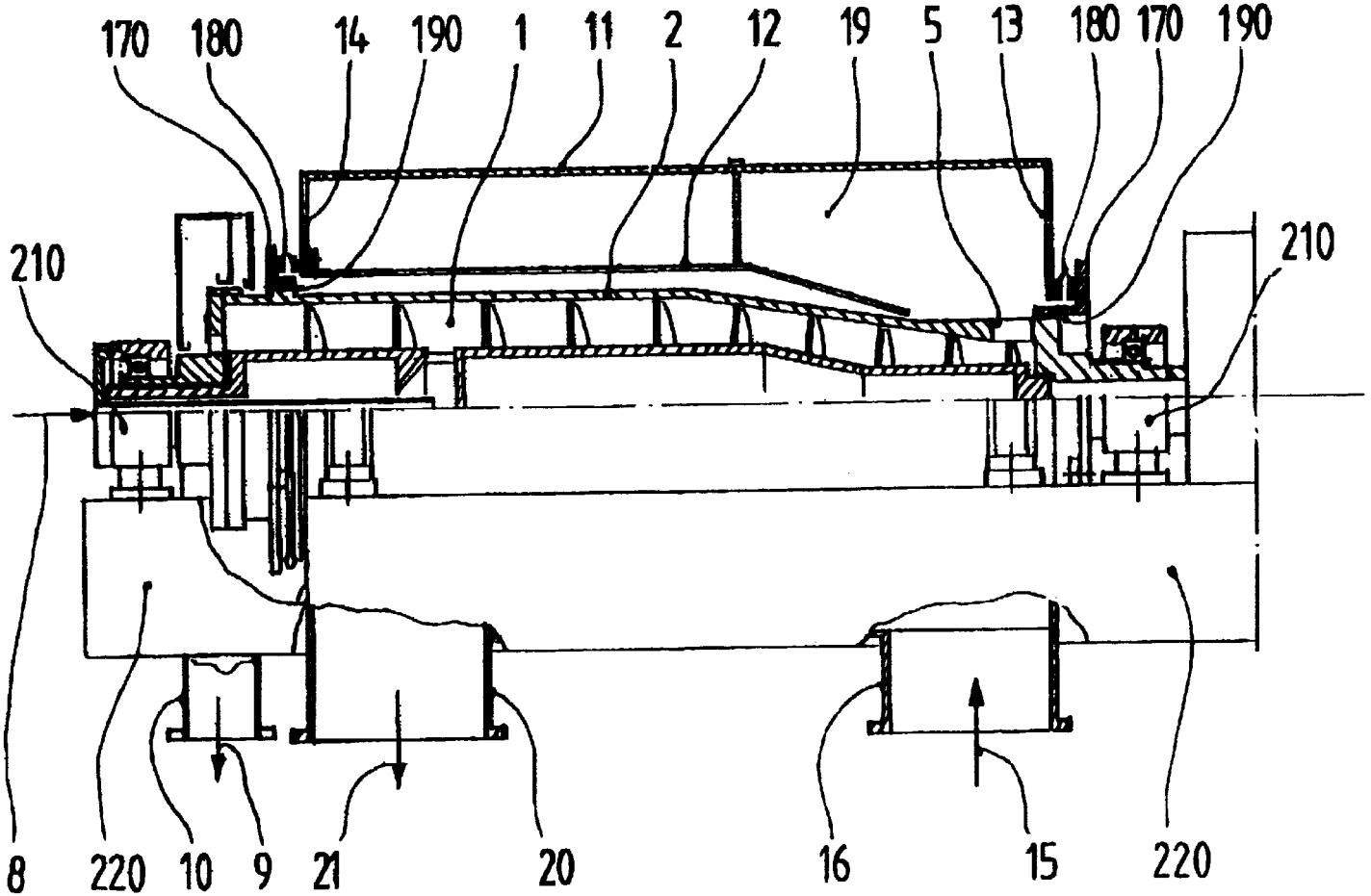
FIG. 9 a longitudinal section of a centrifuge drier having a housing seal.

The centrifuge drier shown in FIG. 9 again comprises a centrifuge, in the illustrated example a full-jacketed helical-conveyor centrifuge 1, which is surrounded by an outside housing 11 of a spray drier. An inside housing 12 surrounds the centrifuge drum 2.

The outside drier housing 11 and the inside housing 12 constitute the concentric drier chamber 19, through which the drying gas 15 is conducted. The drying gas 15 is supplied through the tangential hot-gas shaft 16, takes up the dewatered solid in the form of a dispersed-particle cloud in the region of the discharge zone 5, transports the solid particles, with increased drying, through the drier chamber 19 in helical paths, and travels as a solids-laden gas 21 toward the exit channel 20. The water separated in the centrifuge 1 is carried off in the central chute 10.

The outside drier housing 11 is sealed at both end walls 13 and 14 against the rapidly-rotating centrifuge drum 2. The gap 190 of the rotary seals 160 is formed by the centrifuge drum 2 and the sealing ring 170, which, like the drum pedestals 210, is rigidly connected to the base frame 220.

The seal gap 190 is guided exactly and in a stable manner by the mounting of the two work surfaces 2 and 170, which form the seal gap 190, to the same carrier 220. Because of the eliminated suspension, the centrifuge drum 2 remains cold, even when hot gas 15 flows through the drier chamber 19, and does not expand, whereas the drier housing 11, through which hot gas 15 flows, expands significantly in the axial and radial directions.

The displacement movements of the two housing end walls 13 and 14 are compensated by a gas-tight, flexible compensator 180 or an elastic diaphragm, or a displaceable sliding ring 300, with respect to the rigidly-mounted sealing ring 170, so the seal gap 190 is not changed.

Figure 10:
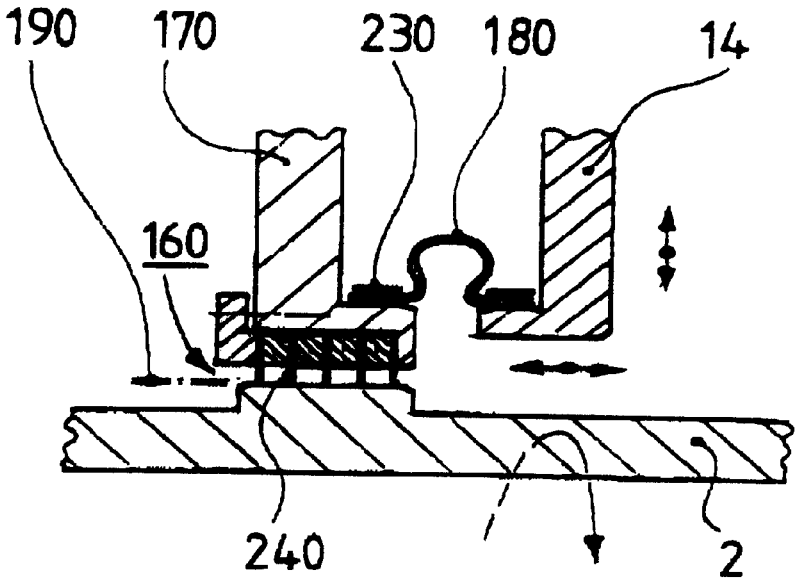
FIG. 10 a contactless labyrinth seal for a centrifuge drier.

FIG. 10 shows in detail a contactless labyrinth seal for a centrifuge drier, which connects the sealing ring 170 that is rigidly mounted on the frame 220 to the axially- and radially-displaceable drier end wall 14 in a gas-tight manner by means of a compensator 180. The flexible compensator 180 is connected in a gas-tight manner to both the sealing ring 170 and the end wall 14 by, for example, tightening straps 230 or other securing means.

The seal gap 190 between the crests 240 of the labyrinth seal and the rotating surface of the centrifuge drum 2 can be kept very narrow (0.3–0.5 mm), because the displacement movement of the end wall 14 is not transmitted onto the labyrinth seal.

All of the non-rotating parts are hatched from right to left; all of the rotating parts are hatched from left to right.

Figure 11:
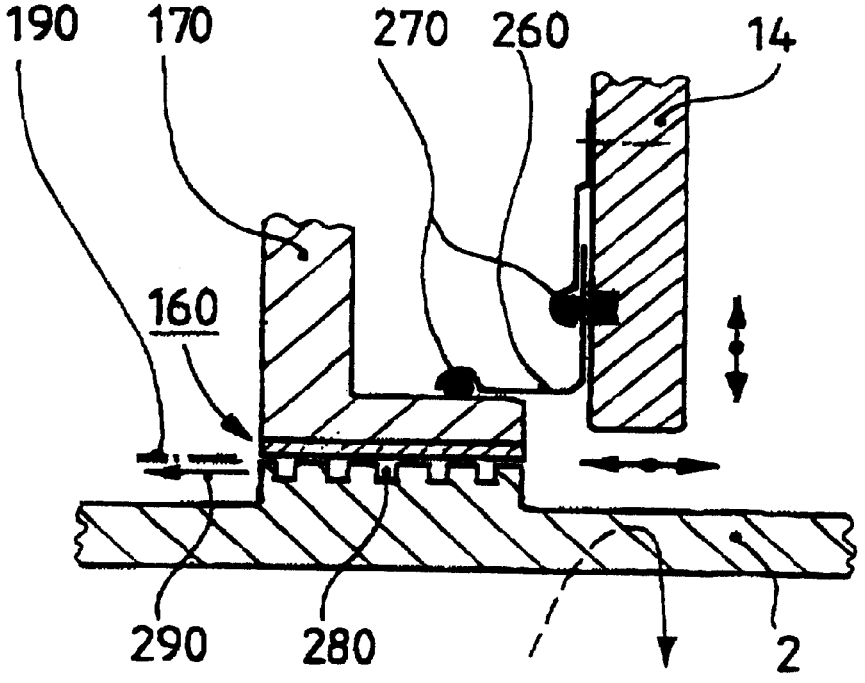
FIG. 11 a contactless, threaded conveying seal for a centrifuge drier.

FIG. 11 shows a contactless rotary seal 160 in the form of a threaded seal for a centrifuge drier, with, for example, a vacuum existing in the drier chamber to the right of the end wall 14.

The sliding and displacement movements of the end wall 13 or 14 of the drier during the heating or cooling phase of the drier housing 11 are compensated by a sheet-metal ring 260 that is sealed by heat-resistant O-rings 270, and can slide on the housing end wall 13 or 14, as well as on the rigidly-mounted sealing ring 170. Because of the thread pitches 280 in the surface of the centrifuge drum 2, the narrow seal gap 190 of the rotary seal 160 embodied as a threaded conveying sealing ring effects a conveying action that counteracts the vacuum in the drier, and a gas-counterpressure that prevents the entrance of secondary air into the drier chamber 19. The thread pitches 280 can also be filled with a fluid sealing medium, for example water or sealing gas, which is conveyed through the thread pitches 280.

Figure 12:
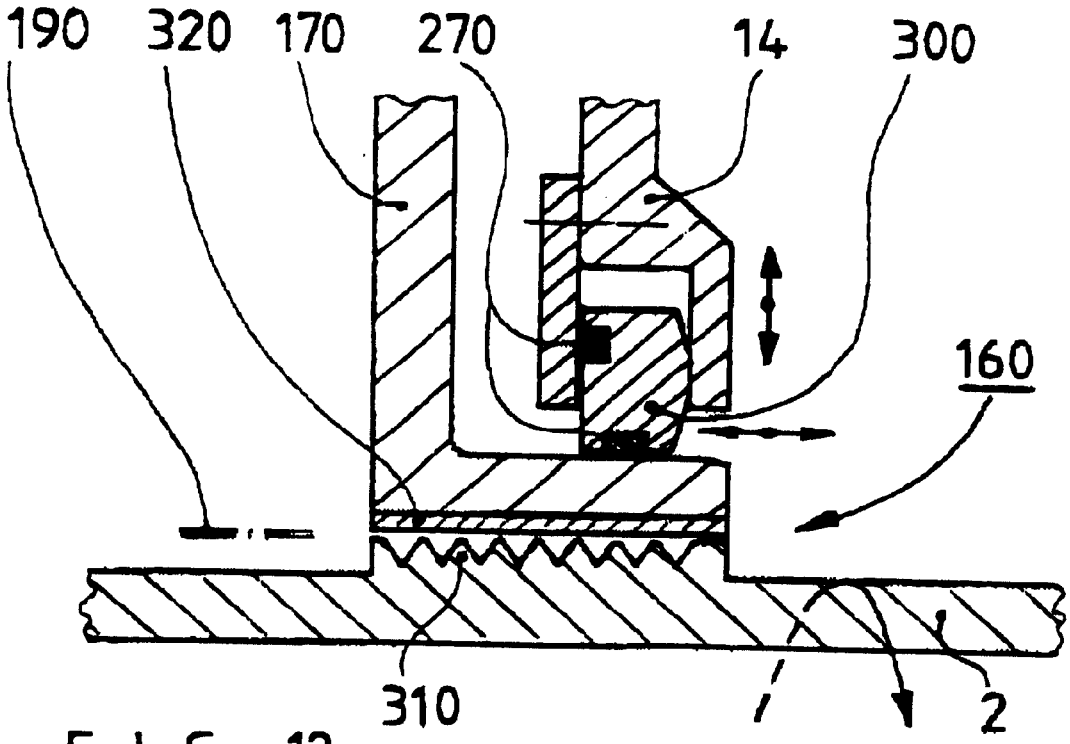
FIG. 12 a contactless, threaded conveying seal having a sharp-crested thread.

FIG. 12 shows a contactless rotary seal 160 having a sharp-crested thread 310, which rotates with a narrow gap 190 inside a soft cylinder surface 320. The conveying action of the threaded seal compensates the vacuum prevailing in the drier. The displaceably-moving drier housing 11 is compensated by the sliding ring 300 in the gap. The sliding ring 300 itself is displaceably sealed by heat-resistant O-rings at both the drier end wall 14 and the rigidly-mounted sealing ring 170.

Figure 13:
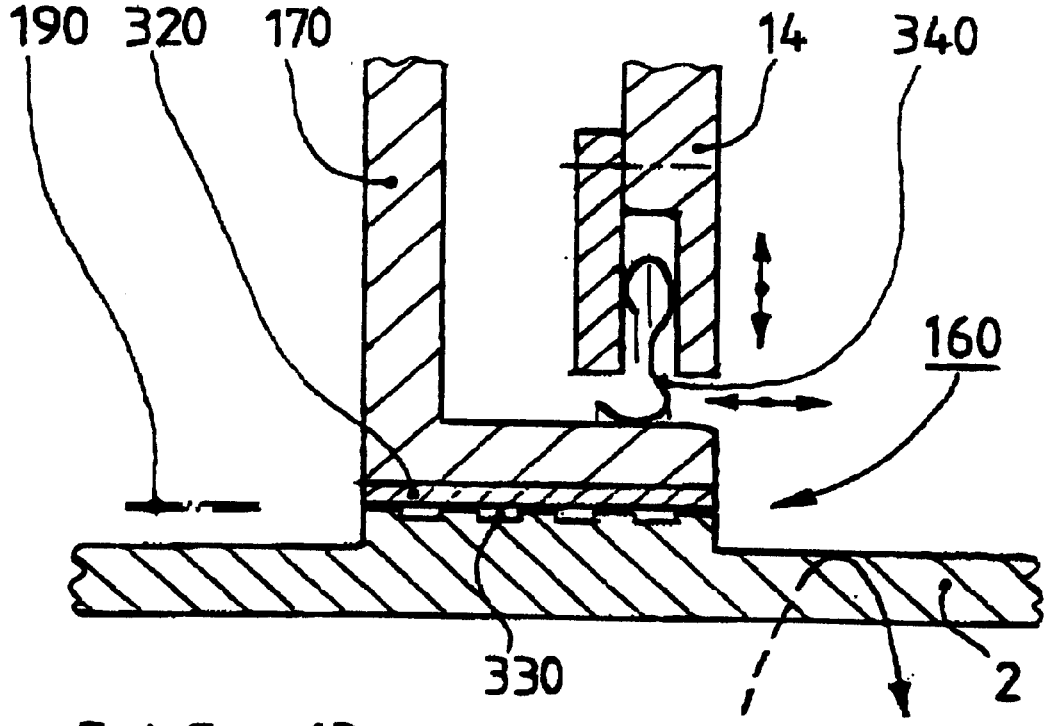
FIG. 13 a contactless seal with shallow grooves.

FIG. 13 shows a contactless rotary seal 160 having shallow grooves, the seal rotating in a soft cylinder bushing 320 comprising sliding-bearing materials with a very narrow gap 190. The displacement movement of the end wall 13 or 14 of the drier housing 11 is compensated by a sliding ring 340 that is resilient in the radial and axial directions.

What is claimed is:

1. A device for dewatering and drying suspensions, comprising:

a base frame;

a centrifuge mounted on the base frame and having a rotating drum with a rotating jacket surface, an entrance zone and a discharge zone, wherein the suspension is supplied as a thin mass to the entrance zone, and a pre-dewatered suspension is spun, as a solid in dispersed-particle form with a dry-substance content in a range of about 15 to about 35 weight percent, to the discharge zone, a drying device for convection-drying the spun solid particles, the drying device including a stationary drier housing at least partially surrounding the rotating drum of the centrifuge and having two axial ends, and a hot-gas generator adapted for conducting hot gas through the stationary drier housing in order to subject dispersed solid particles to a brief drying of a few seconds on their flight path until they exit the drier housing, wherein the stationary drier housing is limited on its radial inside by the rotating jacket surface of the centrifuge, on its radial outside by a cylinder wall and on its end sides by radial end walls; and a multi-stage sealing system comprising rotary seals and elastic or displaceable sealing elements, against the stationary end walls of the drier housing, a sealing ring disposed at each of two axial ends of the drier housing, thereby forming an axial gap from the respectively-adjacent end wall of the drier housing, the sealing ring is being mounted to the base frame, thereby forming a seal gap that extends around the rotating jacket surface of the centrifuge, with each seal gap being sealed by one of the rotary seals, and the axial gap between each sealing ring and the respectively-adjacent end wall of the drier housing is being sealed by the elastic or displaceable sealing elements.

2. The device according to claim 1, wherein the seal gap his sealed contact-free by means of a labyrinth seal or threaded conveying seal.

3. The device according to claim 2, wherein the labyrinth seal has webs that comprise a soft material or are embodied as a sealing brush, with the seal gap being very narrow.

4. The device according to claim 2, wherein the seal gap is changeable by a pressing pressure on the labyrinth seal.

5. The device according to claim 1, wherein the rotary seal is embodied to build up gas-counterpressure at a present pressure drop between an inside and an outside of the drier housing.

6. The device according to claim 1, wherein a fluid sealing medium is incorporated into a part of the seal gap of the rotary seal.

7. The device according to claim 1, wherein a low-oxygen sealing gas is introduced into the seal gap.

8. The device according to claim 1, wherein a contacting sliding-ring seal is provided as a rotary seal.

9. The device according to claim 1, wherein the drier housing is connected, in a gas-tight manner and so as to be displaced, to the sealing ring by an elastic diaphragm.

10. The device according to claim 1, and further including a sliding ring, wherein the drier housing is connected, tightly, and so as to be displaced, to the sealing ring, by the sliding ring.

11. The device according to claim 10, and further including heat-resistant O-rings, wherein the sliding ring is displaceably sealed against the drier housing and the sealing ring by way of the heat-resistant O-rings.

12. A device for dewatering and drying suspensions, comprising:

a centrifuge having a rotating drum with a rotating jacket surface, an entrance zone in which a suspension is supplied as a thin mass, and a discharge zone to which a pre-dewatered suspension is spun, as a solid in dispersed-particle form with a dry-substance content in a range of about 15 to about 35 weight percent;

a drying device for convection-drying the spun solid particles, the drying device including a stationary drier housing defining a chamber and at least partially surrounding the rotating drum of the centrifuge, and a hot-gas generator whose hot gas is conducted through the stationary drier housing in order to subject the dispersed solid particles to a brief drying of a few seconds on their flight path until they exit the drier housing, the stationary drier housing being limited on its radial inside by the rotating jacket surface of the centrifuge, on its radial outside by a cylinder wall and on its end sides by radial end walls;

wherein the rotating jacket surface of the centrifuge includes turbulence blades for generating circulating, torus-shaped, rolling turbulences inside the drier housing.

13. The device according to claim 12, wherein the turbulence blades include solid-sheet regions, perforated sections and gaps.

14. The device according to claim 12, wherein the turbulence blades include conveying devices in at least one of the axial and radial directions for the drying gas and the solid.

15. The device according to claim 12, wherein the turbulence blades include comminution devices.

16. The device according to claim 12, further including at least one turbine-like fan wheel disposed at the centrifuge drum.

17. The device according claim 12, further including stationary diverting surfaces arranged in a region of the discharge zone of the centrifuge for diverting the centrifuged, dispersed particles in an axial direction of the drier housing.

18. The device according to claim 17, wherein at least one of the diverting surfaces and the drier housing comprise gas-permeable walls and are ventilated from the back.

19. The device according to claim 17, wherein each diverting surface comprises a plurality of radial or peripheral sections assembled by at least one of angle, curvature and surface structures.

20. The device according to claim 17, further including rotating clearing blades disposed in front of the diverting surfaces to free the diverting surfaces from particle deposits.

21. The device according to claim 20, wherein the cleaning blades are mounted to the centrifuge drum.

22. The device according to claim 17, further including gas-aspirating and gas-discharging blower blades which cooperate with the diverting surfaces, and are mounted to the centrifuge drum.

23. The device according to claim 22, wherein the blower blades convey dust-laden hot gas a out of the drier chamber and into the discharge zone, with the surfaces of the discharged solid particles being coated with dry, fine dust.

24. The device according to claim 22, wherein the blower blades have at least one of aspiration openings to the drier chamber, inclined aspiration edges and inclined side walls.

25. The device according to claim 22, wherein the blower blades comprise at least one of forward-curved, radial blades and forward-curved axial blades.

26. The device according to claim 22, wherein the blower blades comprise backward-curved blades.

27. The device according to claim 17, wherein the rotating turbulence blades are arranged in the drier chamber so as to cooperate with the diverting surfaces.

28. The device according to claim 17, wherein the turbulence blades are such arranged so that at lease one of the drying gas and dust blows against at least one of the diverting surfaces and the drier end walls.

29. The device according to claim 12, wherein the rotating turbulence blades are adapted to aspirate and convey dust-laden gas out of the drier chamber.

30. The device according to claim 12, wherein the rotating turbulence blades are adapted to convey dispersed particles.

31. The device according to claim 12, further including conical or bowl-shaped perforated sheets comprising at least one sections built into the drier chamber for better gas distribution.

32. The device according to claim 31, wherein the perforated sheets are spatially curved at least one time in the manner, of a corrugated sheet.

33. The device according to claim 31, wherein the holes of the perforated sheets for the passage of gas are circular or slot-shaped, and the have a free aperture ratio in t radial or peripheral sections that varies greatly from 0 to 100%.

34. The device according to claim 31, wherein the perforated sheets include radial or peripheral sections that partially comprise solid sheets or slot openings.

35. The device according to claim 12, further including directing sheets disposed in the drier chamber, at least in a region of the discharge zone of the dispersed particles, or in the entrance region of the hot gas.

36. The device according to claim 35, wherein the directing sheets in the entrance region have identical or varying gas-passage openings that influence at least one of the direction and the speed of the hot gas.

37. The device according to claim 12, further including at least partially-helical directing sheets that form a closed directing channel arranged in the drier chamber.

38. The device according to claim 12, further including non-rotating directing blades cooperating with the rotating turbulence blades and being mounted in the drier chamber.

39. The device according to claim 12, wherein the discharge zone of the centrifuge comprises solids-discharge openings configured so that hot gas is aspirated from the drier chamber into the interior of the centrifuge, where it pre-dries the moist solid still inside the centrifuges.

40. A device for dewatering and drying suspensions, comprising:

a centrifuge, having a rotating drum with a rotating jacket surface, an entrance zone and a discharge zone, wherein a suspension is supplied as a thin mass to the entrance zone, and a pre-dewatered suspension is spun, as a solid in dispersed-particle form with a dry-substance content in a range of about 15 to about 35 weight percent, to the discharge zone;

drying device for convection-drying the spun solid particles, the drying device comprising a stationary drier housing defining a drier chamber and at least partially surrounding the rotating drum of the centrifuge, and a hot-gas generator whose hot gas is conducted through the stationary drier housing in order to subject dispersed solid particles to a brief drying of a few seconds on their flight path until they exit the drier housing, the stationary drier housing being limited on its radial inside by the rotating jacket surface of the centrifuge, on its radial outside by a cylinder wall and on its end sides by radial end walls; and diverting surfaces and gas-aspirating and gas-discharging blower blades cooperating with the diverting surfaces in a region of the discharge zone of the centrifuge and being mounted to the centrifuge drum.

41. The device according to claim 40, wherein the blower blades convey dust-laden hot gas out of the drier chamber and into the discharge zone, with surfaces of the discharged solid particles being coated with dry, fine dust.

42. The device according to claim 40, wherein the blower blades have at least one of aspiration openings to the drier chamber, inclined aspiration edges and inclined side walls.

43. The device according to claim 40, wherein the blower blades comprise at least one of forward-curved-, radial blades and forward-curved axial blades.

44. The device according to claim 40, wherein the blower blades comprise backward-curved blades.

45. The device according to claim 40, further comprising conical or bowl-shaped perforated sheets comprising at least one sections built into the drier chamber for better gas distribution.

46. The device according to claim 45, wherein the perforated sheets are spatially curved at least one time in the manner of a corrugated sheet.

47. The device according to claim 45, wherein the holes of the perforated sheets for the passage of gas are circular or slot-shaped, and have a free aperture ratio in the radial or peripheral sections that varies from 0 to 100%.

48. The device according to claim 45, wherein the perforated sheets have radial or peripheral sections that partially comprise solid sheets or slot openings.

49. The device according to claim 40, further including directing sheets arranged in the drier chamber, at least in a region of the discharge zone of the dispersed particles, or in the entrance region of the hot gas.

50. The device according to claim 49, wherein the directing sheets in the entrance region have identical or varying gas-passage openings that influence at least one of the direction and the speed of the hot gas.

51. The device according to claim 40, further including at least partially-helical directing sheets that form a closed directing channel disposed in the drier chamber.

52. The device according to claim 40, wherein the rotating jacket surface of the centrifuge includes turbulence blades for generating circulating, torus-shaped, rolling turbulences inside the drier housing and further including non-rotating directing blades cooperating with the rotating turbulence blades and being mounted in the drier chamber.

53. The device according to claim 40, wherein the discharge zone of the centrifuge comprises solids-discharge openings configured so that hot gas is aspirated from the drier chamber into the interior of the centrifuge, where it pre-dries the moist solid still inside the centrifuge.

54. The device according to claim 40, further including turbulence blades for swirling the hot gas inside the drier housing.

55. The device according to claim 40, further including at least one turbine-like fan wheel is mounted to the centrifuge drum.

* * * * *